US007035568B2

(12) United States Patent
Sato et al.

(10) Patent No.: US 7,035,568 B2
(45) Date of Patent: Apr. 25, 2006

(54) IMAGE FORMING DEVICE INCLUDING IMAGE READER

(75) Inventors: Shougo Sato, Seto (JP); Tsutomu Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/629,562

(22) Filed: Jul. 30, 2003

(65) Prior Publication Data

US 2004/0022555 A1 Feb. 5, 2004

(30) Foreign Application Priority Data

Aug. 5, 2002 (JP) ..... 2002-227068

(51) Int. Cl.
*G03G 15/00* (2006.01)

(52) U.S. Cl. ..... 399/107; 399/405

(58) Field of Classification Search ..... 399/107, 399/110, 111, 113, 114, 125, 393, 405
See application file for complete search history.

(56) References Cited

U.S. PATENT DOCUMENTS 5,477,306 A 12/1995 Iguchi et al.
6,141,512 A * 10/2000 Nagano et al. ..... 399/92
6,741,820 B1 * 5/2004 Nobe et al. ..... 399/110

FOREIGN PATENT DOCUMENTS

| | | |
|---|---|---|
| JP | A 06-130746 | 5/1994 |
| JP | A 07-168410 | 7/1995 |
| JP | A 08-194428 | 7/1996 |
| JP | A 09-185202 | 7/1997 |
| JP | A 11-184197 | 7/1999 |
| JP | A 2000-035742 | 2/2000 |
| JP | A 2000-092275 | 3/2000 |
| JP | A 2001-034141 | 2/2001 |
| JP | A 2001-36680 | 2/2001 |
| JP | A 2001-194847 | 7/2001 |
| JP | A 2001-222202 | 8/2001 |

* cited by examiner

*Primary Examiner*—Hoang Ngo
(74) *Attorney, Agent, or Firm*—Oliff & Berridge, PLC

(57) ABSTRACT

An image forming device includes an image forming section and an image reader section disposed above the image forming section. A main casing that houses the image forming section is formed with a sheet discharge opening formed in either its front or rear surface. A sheet discharge tray is provided to the outside of the main casing at a position under the discharge opening. The sheet discharge tray holds sheets discharged through the discharge opening.

7 Claims, 6 Drawing Sheets

IMAGE FORMING DEVICE INCLUDING IMAGE READER

BACKGROUND OF THE INVENTION

1. Field of the Invention

The present invention relates to an image forming device including an image reader.

2. Description of Related Art

A multi-function device that includes a printer function, a scanner function, and a facsimile function is an example of a conventional image forming device with an image reader. The printer function enables printing on a recording medium such as a sheet of paper. The scanner function enables retrieval of image data that represents an image of a document. The facsimile function enables transmission and reception of image data with a remote device across a transmission circuit.

FIG. 1 shows a multi-function device 101 that includes a printer section 102, a scanner section 103, a sheet-discharge tray 104, and a sheet-supply cassette 105. The printer section 102 is a laser printer that includes a laser unit 113, a process cartridge 111, and a fixing unit 112. The scanner section 103 is a flat bed type scanner disposed on top of the printer section 102. The sheet-discharge tray 104 is interposed between the printer section 102 and the scanner section 103. The sheet-supply cassette 105 is provided below the printer section 102 and supplies a sheet upward toward the process cartridge 111 when the multi-function device 101 is operated to print out a document. The sheet follows an S-shaped path as it is transported from the sheet-supply cassette 105, under the process cartridge 111 of the printer section 102, through the fixing unit 112, and out onto the sheet-discharge tray 104.

SUMMARY OF THE INVENTION

With this configuration, the sheet-supply cassette 105, the printer section 102, the sheet-discharge tray 104, and the scanner section 103 are juxtaposed one on top of the other in the height direction of the multi-function device 101. This limits how small the multi-function device 101 can be designed.

It is an objective of the present invention to provide a compact image forming device having an image reader.

In order to achieve the above-described objective, an image forming device according to the present invention includes a main casing, an image forming section, an image reader section, a sheet supply unit, a transfer unit, a sheet discharge unit, and a sheet discharge tray.

The main casing includes a front surface and a rear surface on opposite sides thereof. One of the front surface and the rear surface is formed with a sheet discharge opening The image forming section is disposed within the main casing and includes an input reception unit and a process unit. The input reception unit receives image data from an external source. The process unit includes an electrostatic latent image bearing member, an electrostatic latent image forming unit, and a developing agent supply unit. The electrostatic latent image forming unit forms an electrostatic latent image on the electrostatic latent image bearing member based on the image data received by the input reception unit. The developing agent supply unit supplies developing agent to the electrostatic latent image bearing member to develop the electrostatic latent image on the electrostatic latent image bearing member into a visible image using the developing agent.

The image reader section is disposed above the image forming section and includes an image reader and an output unit. The image reader picks up image information from a document. The output unit outputs the image information to an external device.

The sheet supply unit supplies a sheet to the process unit.

The transfer unit transfers the visible image from the electrostatic latent image bearing member onto the sheet from the sheet supply unit.

The sheet discharge unit discharges the sheet with the visible image through the discharge opening in the main casing.

The sheet discharge tray is provided to the outside of the main casing at a position under the discharge opening. The sheet discharge tray holds the sheet discharged through the discharge opening.

BRIEF DESCRIPTION OF THE DRAWINGS

The above and other objects, features and advantages of the invention will become more apparent from reading the following description of embodiments taken in connection with the accompanying drawings in which.

DETAILED DESCRIPTION OF THE EMBODIMENTS

Figure 2:
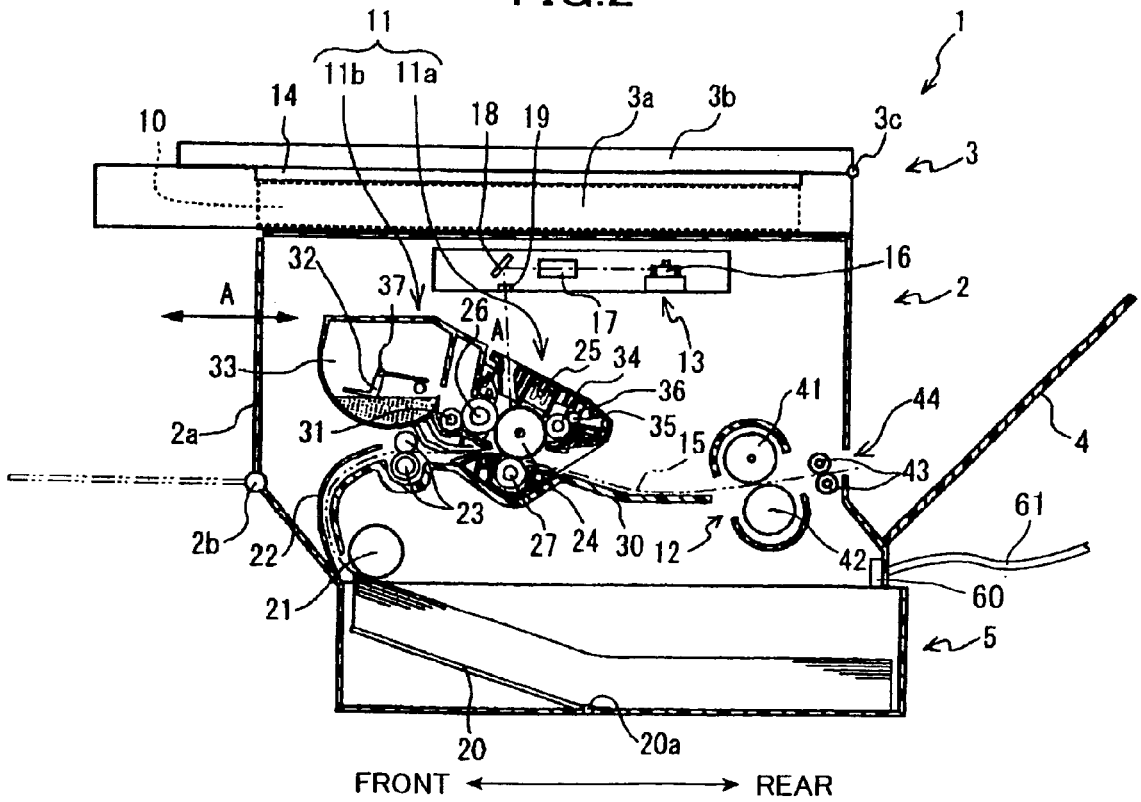
FIG. 2 is a cross-sectional view showing a multi-function device according to a first embodiment of the present invention.

Next, image forming devices according to embodiments of the present invention will be described with reference to the attached drawings. First, a multi-function device 1 according to a first embodiment of the present invention will be described with reference to FIG. 2. FIG. 2 is a cross-sectional view showing the multi-function device 1 divided through its center. The front side of the multi-function device 1 is shown facing to the left in FIG. 2.

Figure 1:
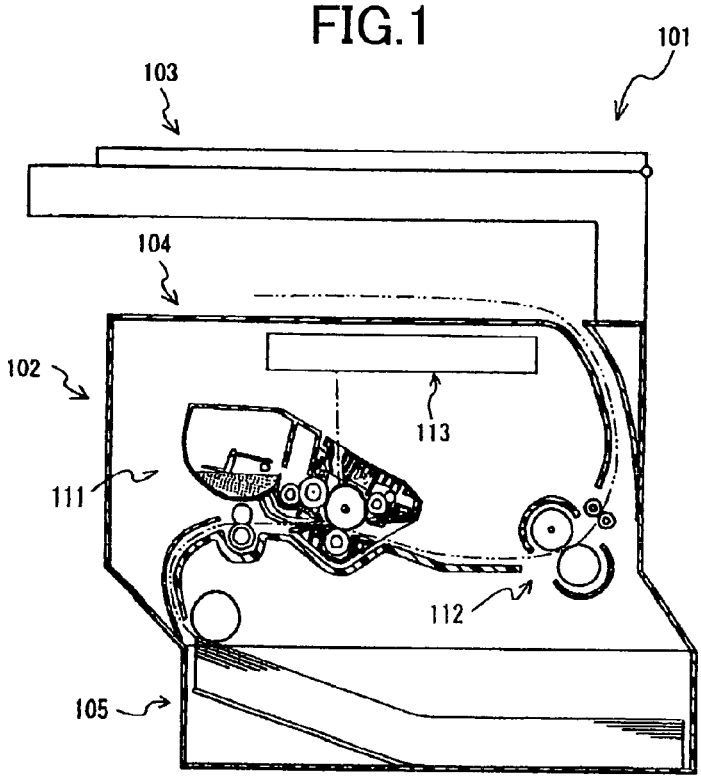
FIG. 1 is a cross-sectional view showing a conventional image forming device with a scanner function.

The multi-function device 1 has a main casing with a substantially rectangular parallelepiped shape as viewed from the side. The multi-function device 1 is capable of performing a printer function and a scanner function and, for this purpose, includes a printer section 2 and a scanner section 3. The printer section 2 is a laser printer and includes configuration for performing the printer function. The scanner section 3 is disposed above the printer section 2. The scanner section 3 is a flat bed type scanner and includes configuration for performing the scanner function. The multi-function device 1 further includes a sheet-supply cassette 5 that is disposed below and shifted slightly to the rear from the position of the printer section 2. The scanner section 3, the printer section 2, and the sheet-supply cassette 5 are juxtaposed in a vertically overlapping manner, that is, one on top of the other in the height dimension of the multi-function device 1. The multi-function device 1 has a somewhat elongated rectangular shape as viewed in plan. More specifically, the multi-function device 1 is somewhat longer in its left/right dimension than in its front/rear dimension. It should be noted that left and right of the multi-function device 1 in FIG. 1 are the directions away from and toward, respectively, the viewer of FIG. 1. The multi-function device 1 further includes a sheet-discharge tray 4. The sheet-discharge tray 4 is connected to the rear surface of the multi-function device 1 at a position in between the printer section 2 and the sheet-supply cassette 5 and extends rearward. The sheet-discharge tray 4 and the sheet-supply cassette 5 partially overlap each other in the vertical direction. As a result, the main casing can be formed more compact (in plan) and the multi-function device 1 can be installed on a surface with only a small surface area with respect to an imaginary horizontal plane.

The scanner section 3 is located at the uppermost portion of the multi-function device 1 and includes a flatbed image reader 3*a*, a cover 3*b*, a shaft 3*c*, a contact-type image sensor 10, and a glass plate 14. The flatbed image reader 3*a* has a substantially rectangular parallelepiped shape as viewed in plan. The flatbed image reader 3*a* has a predetermined thickness in the vertical direction. The shaft 3*c* extends in the left/right direction at a position at the upper rear edge of the flatbed image reader 3*a*. The cover 3*b* has a substantially rectangular parallelepiped shape as viewed in plan. One lengthwise edge of the cover 3*b* is pivotably supported on the shaft 3*c* and the other lengthwise edge is movable up and down with the shaft 3*c* serving as a fulcrum. The upper surface of the flatbed image reader 3*a* is open. The contact-type image sensor 10 is provided within the flatbed image reader 3*a*. Although not shown in the drawings, a mechanism is provided for moving the contact-type image sensor 10 leftward and rightward. The glass plate 14 covers the open upper side of the contact-type image sensor 10 and is for supporting a document while the contact-type image sensor 10 picks up an image from the document.

The image sensor 10 is oriented with its lengthwise dimension aligned with the front to rear direction of the multi-function device 1. Although not shown in the drawings, the contact-type image sensor 10 includes contact image sensors (CIS), a rod lens array, three colors (i.e., red, green, and blue) of light emitting elements (LED), and a mirror. The CIS is a sensor that uses Complementary Metal Oxide Semiconductors (CMOS). Light emitted from the LEDs is reflected from the mirror and exposes the document placed on the glass plate 14. The light reflects off the document, and is focused on the CIS by the long lens array. In this way, image information of the document can be picked up.

The sheet-supply cassette 5 is located at the lowermost section of the multi-function device 1. The sheet-supply cassette 5 supports a plurality of sheets 15 in a stacked condition. When the sheet-supply cassette 5 is to be refilled with sheets 15, the sheet-supply cassette 5 is pulled forward out from the main casing of the multi-function device 1 in the manner of a desk drawer. The sheet-supply cassette 5 includes a pressing plate 20 and a support shaft 20*a*. The pressing plate 20 is provided at the base of the sheet-supply cassette 5. The support shaft 20*a* is fixed at the substantial center of the sheet-supply cassette 5 with respect to the front/rear direction. The pressing plate 20 is pivotably supported on the support shaft 20*a* so that the edge of the pressing plate 20 opposite from the support shaft 20*a* can move vertically. Although not shown in the drawings, a spring is provided to the underside of the pressing plate 20 and urges the pressing plate 20 to pivot in the direction of a sheet-feed roller 21 to be described later. The pressing plate 20 swings downward around the support shaft 20*a* against the urging force of the spring to a degree that increases with the amount of sheets 15 stacked on the pressing plate 20.

The printer section 2 is disposed between the scanner section 3 and the sheet-supply cassette 5. The printer section 2 includes a laser unit 13, a process cartridge 11, and a fixing unit 12. The laser unit 13 is disposed in the upper section of the main casing. The process cartridge 11 is disposed in the front portion of the multi-function device 1 at a position below the laser unit 13. The fixing unit 12 is located to the rear of the process cartridge 11. Further, the sheet-feed roller 21 is disposed at a position that is below the front side of the process cartridge 11. The sheets 15 stacked on the pressing plate 20 are pressed against the sheet-feed roller 21. An arch-shaped sheet-supply path 22 is provided directly below the process cartridge 11 and serves to guide the sheets 15 from the sheet-feed roller 21 toward registration rollers 23. A transport guide 30 is interposed between the process cartridge 11 and the fixing unit 12. The transport guide 30 guides sheets 15 from the process cartridge 11 to the fixing unit 12. Sheet-discharge rollers 43 are provided to the rear (i.e., to the right as viewed in FIG. 2) of the fixing unit 12. A sheet-discharge port 44 is formed in the rear surface of the main casing. The sheet-discharge rollers 43 guide sheets out from the main casing through the sheet-discharge port 44 and onto the sheet-discharge tray 4.

The laser unit 13 includes a laser emitting unit (not shown), a polygon mirror 16, a fθ lens 17, a reflecting mirror 18, and a relay lens 19. The laser emitting unit emits laser light based on print data. The polygon mirror 16 is driven to rotate to scan the emitted laser light in a main scanning direction. The fθ lens 17 regulates the laser light reflected from the polygon mirror 16 to a fixed scanning speed. The reflecting mirror 18 reflects the laser light from the fθ lens 17 toward process cartridge 11. The relay lens 19 regulates focal point of the laser light reflected from the reflecting mirror 18 in order to focus the laser light on the surface of a photosensitive drum 24 to be described later. With this configuration, the laser beam is irradiated from the laser beam emitting section based upon predetermined image data and passes through or is reflected by the polygon mirror 16, the fθ lens 17, the reflecting mirror 18, and the relay lens 19 in this order as indicated by an alternate long and dash line A to expose and scan the surface of the photosensitive drum 24 of the process cartridge 11.

The process cartridge 11 includes a drum cartridge 11*a* and a developing cartridge 11*b* that is detachably mounted on the drum cartridge 11*a*. The drum cartridge 11*a* includes the photosensitive drum 24, a charger 25, a transfer roller 27, a cleaning roller 34, a secondary roller 35, and the like. The developing cartridge 11*b* includes an developing roller 26, a supply roller 31, and a toner box 33. The developing roller 26 and the toner box 33 are provided as integral components of the developing cartridge 11*b*.

The photosensitive drum 24 is arranged beside and in contact with the developing roller 26. The photosensitive drum 24 is oriented with its rotational axis aligned parallel with the rotational axis of the developing roller 26. The photosensitive drum 24 is rotatable counterclockwise as viewed in FIG. 2. The photosensitive drum 24 includes a drum-shaped base coated with an organic photoelectric conductor. The drum-shaped base is made from a conductive material. A charge transfer layer is dispersed with a charge generation material. When the photosensitive drum 24 is exposed by a laser beam, the charge generation material absorbs the light and generates a charge. The charge is transferred onto the surface of the photosensitive drum 24 through the charge transfer layer and counteracts the surface potential charged by the charger 25. As a result, a potential difference is generated between regions of the photosensitive drum 24 that were exposed and regions that were not exposed by the laser light. By selectively exposing and scanning the surface of the photosensitive drum 24 with a laser beam based upon print data, an electrostatic latent image is formed on the photosensitive drum 24.

The charger 25 is disposed above the photosensitive drum 24. The charger 25 is separated from and out of contact with the photosensitive drum 24 by a predetermined distance. The charger 25 generates a corona discharge from a wire made from tungsten, for example, to positively charge the surface of the photosensitive drum 24 to a uniform charge of positive polarity.

The developing roller 26 will be described with respect to the condition of the developing cartridge 11*b* being mounted on the drum cartridge 11*a*. The developing roller 26 is disposed further downstream than the charger 25 with respect to the rotation direction of the photosensitive drum 24, that is, the counterclockwise direction as viewed in FIG. 2. The developing roller 26 is rotatable clockwise as viewed in FIG. 2. The developing roller 26 includes a roller shaft made from metal coated with a roller made from a conductive rubber material. A development bias is applied to the developing roller 26 from a not-shown development bias application power supply.

The supply roller 31 is disposed beside the developing roller 26 on the opposite side from the photosensitive drum 24 across the developing roller 26. The supply roller 31 is in pressed contact with the developing roller 26. The supply roller 31 includes a roller shaft made of metal covered with a roller made of a conductive foaming material. The supply roller 31 triboelectrifies toner supplied to the developing roller 26.

The toner box 33 is provided beside the supply roller 31. The inside of the toner box 33 is filled with toner to be supplied to the developing roller 31 by the supply roller 33. In this embodiment, nonmagnetic, single-component toner with a positive charging nature polarity is used as a developer. The toner is a polymeric toner obtained by copolymerizing polymeric monomers using a well-known polymerization method such as suspension polymerization. Examples of polymeric monomers include styrene monomers and acrylic monomers. Styrene is an example of a styrene monomer. Examples of acrylic monomers include acrylic acid, alkyl (C1 to C4) acrylate, and alkyl (C1 to C4) methacrylate. Carbon black or other coloring agent, wax, and the like are mixed in the polymeric toner. An externally added agent such as silica is also added in order to improve fluidity. A particle diameter of the polymeric toner is approximately 6 to 10 μm.

An agitator 32 is supported by a rotation shaft 37 provided in the center of the toner box 33. The toner in the toner box 33 is agitated by counterclockwise (as viewed in FIG. 2) rotation of the agitator 36.

The transfer roller 27 is disposed below the photosensitive drum 24 and downstream from the developing roller 26 with respect to the rotating direction (counterclockwise as viewed in FIG. 2) of the photosensitive drum 24. The transfer roller 27 is rotatable clockwise. The transfer roller 27 includes a metal roller shaft covered with a roller made from an ion-conductive rubber material. During the transfer process, a transfer bias circuit unit (not shown) applies a transfer forward bias to the transfer roller 30. The transfer forward bias generates a potential difference between the surfaces of the photosensitive drum 24 and the transfer roller 27. The potential difference electrically attracts toner that electrostatically clings to the surface of the photosensitive drum 24 to move toward the transfer roller 27.

The cleaning roller 34 is arranged beside the photosensitive drum 24 at a position downstream from the transfer roller 27 and upstream from the charger 25 with respect to the rotating direction of photosensitive drum 24. The secondary roller 35 is located on the opposite side of the cleaning roller 34 than the photosensitive drum 24 and is contact with the cleaning roller 34. A pick-up member 36 is in abutment with the secondary roller 35. A cleaning bias circuit (not shown) applies a bias to the cleaning roller 34 and the secondary roller 35.

After toner is transferred onto the sheet 15 from the photosensitive drum 24 by the transfer roller 27, the cleaning roller 34 electrically attracts any residual toner and paper powder that remains on the surface of the photosensitive drum 24. Then, the secondary roller 35 electrically attracts only the paper powder from the cleaning roller 34. The pick-up member 36 catches the paper powder from the secondary roller 35. At this time, the bias is switched so that the toner on the surface of the cleaning roller 34 returns to the photosensitive drum 24 and, by rotation of the photosensitive drum 26, to the developing roller 26. The developing roller 26 returns the toner to the developing cartridge 11*b*. When the cleaning bias is switched, a transfer bias circuit (not shown) applies a transfer reverse bias to the transfer roller 27. Unlike the transfer forward bias, the transfer reverse bias generates a potential difference between the surfaces of the transfer roller 27 and photosensitive drum 24 that transfers toner on the surface of the transfer roller 27 to the surface of the photosensitive drum 24.

The fixing unit 12 is disposed downstream from the process cartridge 11 with respect to the direction of sheet transport. The fixing unit 12 includes a heating roller 41, a pressing roller 42 for pressing the heating roller 41, and a pair of conveying rollers 43. The conveying rollers 43 are provided downstream from the heating roller 41 and the pressing roller 42. The heating roller 41 includes a metal tube and a halogen lamp for heating inside the metal tube. While the sheet 15 from the process cartridge 11 passes between the heating roller 41 and the pressing roller 42, the heating roller 41 pressurizes and heats the toner that was transferred onto the sheet 15 in the process cartridge 11, thereby fixing the toner onto the sheet 15. Afterward, the sheet 15 is transported through the sheet-discharge port 44 to outside the main casing by the conveying rollers 43.

The main casing is formed with an open space at the portion of the front surface that is nearest the printer section 2. The open space is for insertion of the process cartridge 11. A support shaft 2*b* is disposed on a lower edge that partially defines the open space. A front surface cover 2*a* is supported on the support shaft 2*b* so as to be pivotable in the forward and reverse directions in order to respectively open and close the open space. The open condition of the front surface cover 2*a* is indicated by two-dot chain line in FIG. 2. While the front surface cover 2*a* is opened, the process cartridge 11 can be removed from or inserted into the main casing by pulling the process cartridge 11 forward or pushing the process cartridge 11 rearward through the open space.

An input/output interface 60 is provided at the rear portion of the main casing. The input/output interface 60 is connected to a host computer (not shown) by a cable 61. The input/output interface 60 receives image data from the host computer and provides the image data to the printer section 2 for forming images on the sheets 15. The input/output interface 60 also outputs image information that was picked up by the scanner section 3 to the host computer.

Next, operations of the multi-function device 1 of the first embodiment will be described with reference to FIG. 2. First, the operation of the scanner section 3 will be described. When a user wishes to retrieve an image of a document, the user opens up the cover 3*b* of the scanner section 3 and places the document on the glass plate 14 of the flatbed image reader 3*a*. At this time, the side of the document with the image to be picked up faces downward. Hereinafter, the surface of the document with the image to be picked up will be referred to as the front surface. When the scanning operation is started, the contact-type image sensor 10 moves following the lengthwise direction of the scanner section 3 and scans the document one line at a time, wherein the lines extend in the direction perpendicular to the direction of scanner movement. At this time, the direction of scanner movement is the main scanning direction and the direction in which the lines extend is the auxiliary scanning direction.

One row of LEDs is provided for each of the three colors of red, green, and blue. Each LED row extends following the lengthwise direction of the contact-type image sensor 10. While the contact-type image sensor 10 moves in the main scan direction, the rows of different colored LEDs are each illuminated to scan single document lines to perform an auxiliary direction scan. That is, all of the LEDs in the same color LED row are illuminated at the same time. The light from the LEDs is reflected from a mirror toward the document to expose the document. The LED light is reflected from the document toward the rod lens array (not shown). The rod lens array focuses the LED light onto the CIS. At this time, the CIS distinguishes between different intensities of the LED light that was reflected from the document. For example, if the CIS includes contact-type imaging elements that are capable of picking up 12 bits of tone information, then the CIS is capable of distinguishing and picking up information in about 4,096 different gradations of light intensity. When image information for each scan line of the document is picked up for each of the LED colors of red, green, and blue, then color and gradation information about the document can be picked up and processed as image information in the control portion (not shown). The control portion outputs the image information to either the host computer through the input/output interface 60 or to the printer section 2.

Next, the printer section 2 will be described. When the user wants to print a document, the user operates a host computer (not shown) to transmit print data to the multi-function device 1 through the input/output interface 60. On the other hand, when the user wants to copy a document, the user operates the multi-function device 1 to print out the image data of the document whose image was picked up using the scanner section 3. The printer section 2 starts printing based on the print data received from the host computer or the image data of the document from the scanner section 3. When the printer section 2 starts printing, the uppermost sheet 15 in the stack on the pressing plate 20 of the sheet-supply cassette 5 is fed out by friction from the rotating sheet-feed roller 21 and transported to the registration rollers 23 through the sheet-supply path 22.

During this time, the laser emitting unit of the laser unit 13 generates laser light based on a laser drive signal generated by an engine controller (not shown). The laser light is emitted toward the polygon mirror 16. The polygon mirror 16 rotates while reflecting the incident laser light so that the reflected light scans in the main scanning direction, which is the direction perpendicular to the direction in which the sheets 15 are transported. The scanning light from the polygon mirror 16 passes through the fθ lens 17. The fθ lens 17 converts the uniform angular speed of the laser light as reflected from the polygon mirror 16 to a uniform scan speed. The laser light reflects off the reflecting mirror 18 toward the relay lens 19. The relay lens 19 converges the laser light and focuses it on the surface of the photosensitive drum 24.

The charger 25 charges the surface of the photosensitive drum 24 to, for example, a surface potential of approximately 1000 V. The laser beam from the laser unit 13 scans in the main scan direction across the surface of the photosensitive drum 24. The laser beam selectively exposes and does not expose the surface of the photosensitive drum 24 based on the laser drive signal described above. That is, portions of the surface of the photosensitive drum 24 that are to be developed are exposed by the laser light and portions that are not to be developed are not exposed. The surface potential of the photosensitive drum 24 decreases to, for example, approximately 100V at exposed portions, also referred to as bright parts. Because the photosensitive drum 24 rotates counterclockwise as viewed in FIG. 2 at this time, the laser beam also exposes the photosensitive drum 24 in an auxiliary scanning direction. As a result of the two scanning actions, an electrical invisible image, that is, an electrostatic latent image is formed on the surface of the photosensitive drum 27 from exposed areas and unexposed areas, which are also referred to as dark parts.

The toner in the toner box 33 is supplied to the developing roller 26 according to the rotation of the supply roller 31. At this point, the toner is triboelectrically charged to a positive polarity between the supply roller 31 and the developing roller 26 and is further regulated to a layer with constant thickness on the developing roller 26 by a layer-thickness regulating blade (not shown). A positive bias of, for example, approximately 300 to 400 V is applied to the developing roller 26. The toner, which is carried on the developing roller 26 and charged positively, is transferred to the electrostatic latent image formed on the surface of the photosensitive drum 24 when the toner comes into contact with the photosensitive drum 24. That is, because the potential of the developing roller 26 is lower than the potential of the dark parts (+1000 V) and higher than the potential of the bright parts (+100 V) of the electrostatic latent image, the positively-charged toner moves selectively to the bright parts where the potential is lower. In this way, a visible image of toner is formed on the surface of the photosensitive drum 24 and development is performed.

The registration roller 23 performs a registration operation on the sheet 15 to deliver the sheet 15 at a timing wherein the front edge of the visible image formed on the surface of the rotating photosensitive drum 24 and the leading edge of the sheet 15 coincide with each other. A negative bias is applied to the transfer roller 27 while the sheet 15 passes between the photosensitive drum 24 and the transfer roller 27. The negative bias is approximately −200 V in the present embodiment. Because the negative bias applied to the transfer roller 27 is lower than the potential of the bright part (+100 V), the toner electrostatically adhered to the surface of the photosensitive drum 24 moves toward the transfer roller 27. However, the toner is blocked by the sheet 15 and cannot transfer to the transfer roller 27. As a result, the toner is transferred onto the sheet 15. That is, the visible image formed on the surface of the photosensitive drum 24 is transferred onto the sheet 15.

Then, the sheet 15 having the toner transferred thereon is conveyed through the transport guide 30 to the fixing unit 12. Residual charges of the toner and the sheet 15 are removed by a grounded charge removing plate (not shown) when the sheet 15 passes thereby. Then, the heating roller 41 of the fixing unit 12 applies heat of approximately 200 degrees, and the pressing roller 42 applies a pressure, to the sheet 15 with the toner image to fix the toner image permanently on the sheet 15. Note that the heating roller 41 and the pressing roller 42 are each grounded by diodes so that the surface potential of the pressing roller 42 is lower than the surface potential of the heating roller 41. Accordingly, the positively charged toner that clings to the heating roller 41 side of the sheet 15 is electrically attracted to the lower surface potential of the pressing roller 42. Therefore, the potential problem of the toner image being distorted because the toner is attracted to the heating roller 41 at the time of fixing is prevented.

The sheet 15 with the fixed toner image is conveyed by the sheet-discharge rollers 43 through the sheet-discharge port 44 at the side of the main casing and onto the sheet-discharge tray 4. The user is then able to obtain a printed sheet 15.

According to the first embodiment, the scanner section 3 is located above the printer section 2. Sheets 15 that were printed on in the printer section 2 are not transported to the upper portion of the main casing, but are rather guided to the sheet-discharge tray 4, which is connected to the sheet-discharge port 44 in the rear surface of the main casing. As a result, there is no need to provide a space for holding printed and discharged sheets in between the printer section 2 and the scanner section 3. Because the sheet-discharge tray 4 and the sheet-supply cassette 5 partially overlap in the vertical direction, the multi-function device 1 is smaller as viewed in plan and so can be installed in a space with a smaller surface area. Further, by opening the front surface cover 2*a*, the process cartridge process cartridge 11 can be mounted and removed through the front end of the main casing. Therefore, the process cartridge 11 can be installed and removed more easily.

Figure 3:
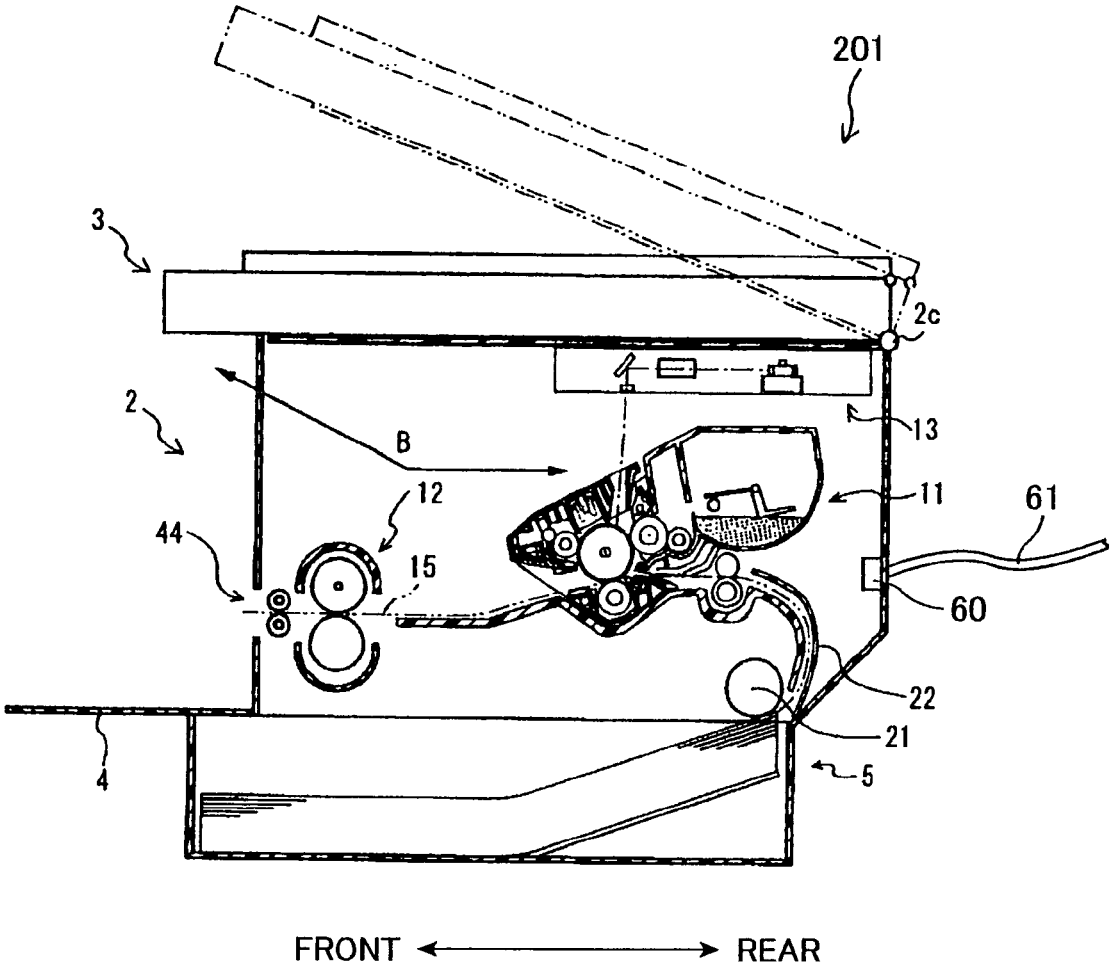
FIG. 3 is a cross-sectional view showing a multi-function device according to a second embodiment of the present invention.

Next, a multi-function device 201 according to a second embodiment of the present invention will be described with reference to FIG. 3. FIG. 3 is a cross-sectional view showing the multi-function device 201 of the second embodiment. It should be noted that the front surface of the multi-function device 201 is shown at the left side of FIG. 3. Components in the multi-function device 201 of the second embodiment that are similar to those in the multi-function device 1 of the first embodiment will referred to using the same numbering and their detailed description omitted to avoid redundancy of description.

The position of the sheet-discharge tray 4 and the transport direction of sheets 15 is different for the multi-function device 201 of the second embodiment than for the multi-function device 1 of the first embodiment. That is, sheets 15 are supplied from the sheet-supply cassette 5 toward the rear surface of the main casing. The sheet-supply path 22 guides the supplied sheets 15 toward the front surface of the main casing. The sheets 15 are further transported and guided below the process cartridge 11 toward the fixing unit 12. After passing through the fixing unit 12, the sheets 15 are discharged out through the sheet-discharge port 44 onto the sheet-discharge tray 4.

The sheet-discharge tray 4 is provided connected to the sheet-discharge port 44. The sheet-discharge tray 4 partially overlaps with the sheet-supply cassette 5 in the vertical direction. Also, a shaft 2*c* is provided at the upper rear edge of the main casing at a position between the printer section 2 and the scanner section 3. The scanner section 3 is pivotably disposed on the shaft 2*c* so that the entire scanner section 3 can be pivoted upward and downward to open and close, respectively, the printer section 2. The upper side of the printer section 2 is opened up when the scanner section 3 is pivoted upward into the posture indicated by two-dot chain line in FIG. 2. At this time, the process cartridge 11 can be mounted into the main casing from a position above the front surface of the main casing in a direction downward and to the rear as indicated by arrows B in FIG. 3.

Other configuration and operations of the multi-function device 201 according to the second embodiment are similar to those of the multi-function device 1 according to the first embodiment.

According to the second embodiment, printed sheets 15 are not transported through the upper portion of the main casing in the same manner as with the first embodiment. The sheets 15 are guided through the sheet-discharge port 44 in the front surface of the main casing onto the sheet-discharge tray 4. Therefore, the user can more easily pick up the discharged sheets 15. Also, the sheet-discharge tray 4 and the sheet-supply cassette 5 overlap in the vertical direction in the same manner as with the first embodiment. Therefore, the multi-function device 201 according to the second embodiment can be installed in a space with only a small horizontally-extending (plan) surface area. The process cartridge 11 can be pulled out from the main casing from a position above the front surface of the main casing. Therefore, the process cartridge 11 is easier to remove from and mount into the main casing.

Next, modifications of the embodiment will be described.

Figure 4:
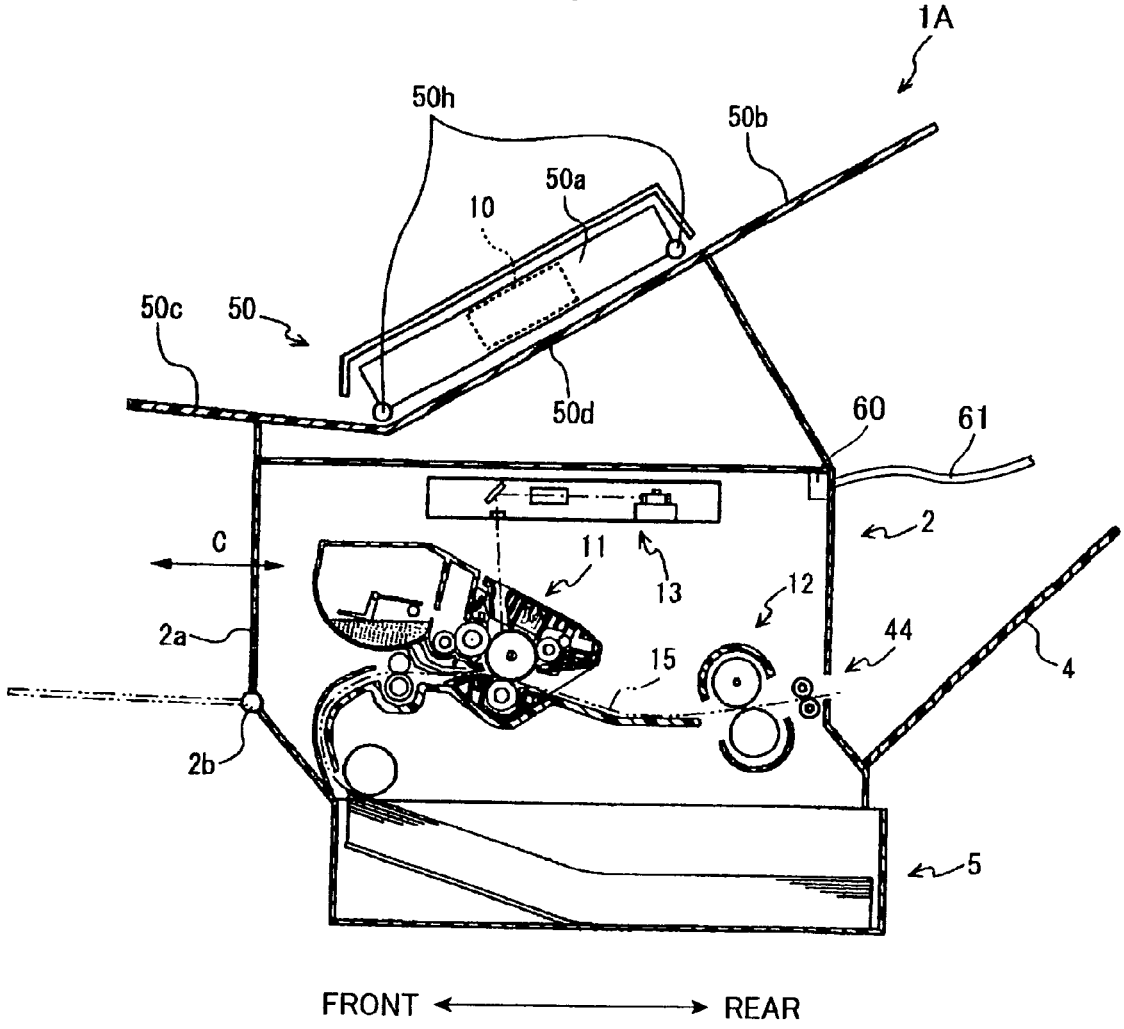
FIG. 4 is a cross-sectional view showing a multi-function device according to a modification of the first embodiment.
Figure 5:
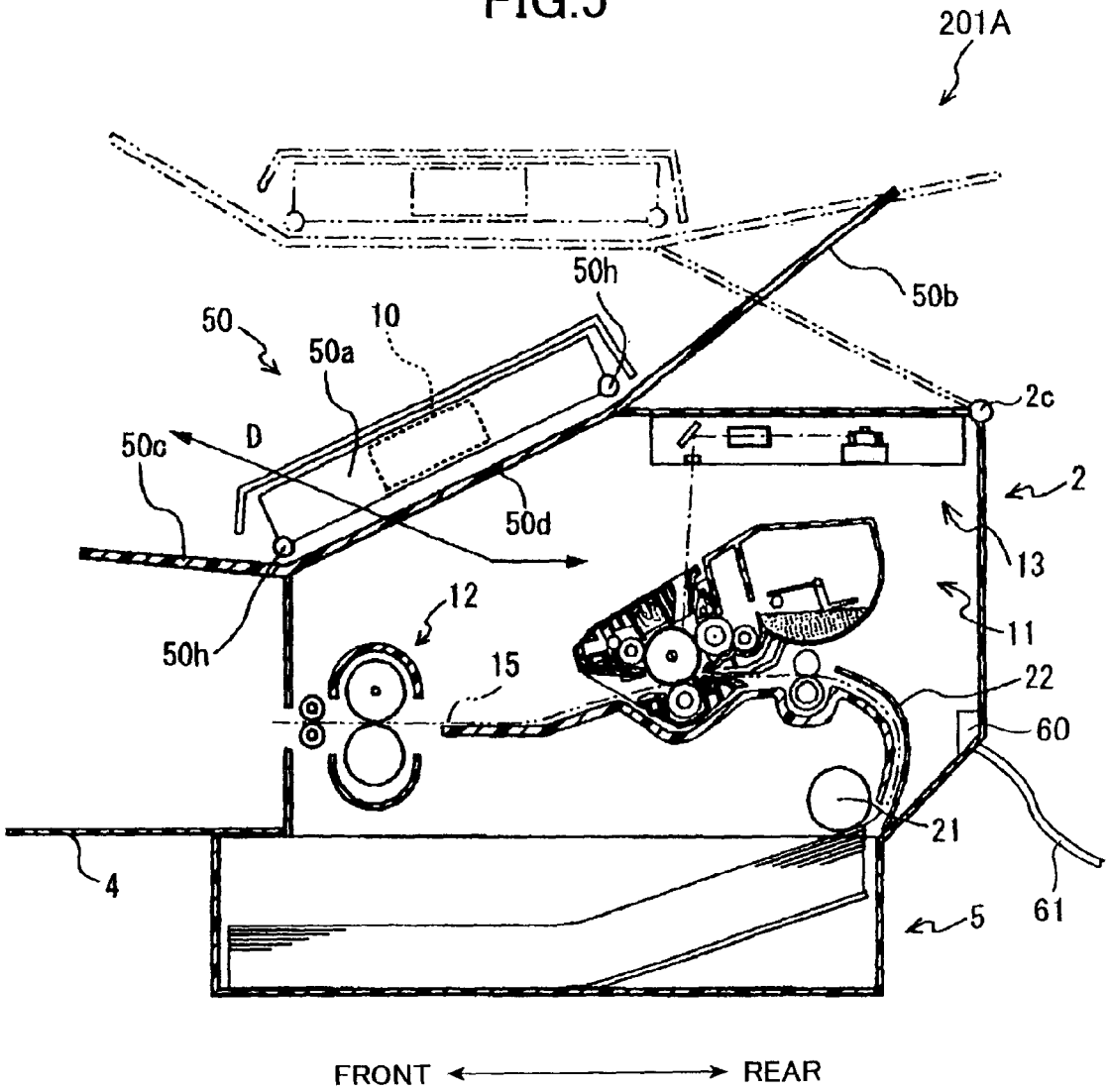
FIG. 5 is a cross-sectional view showing a multi-function device according to a modification of the second embodiment.

In the modifications shown in FIGS. 4 and 5, the scanner section 3 of the first and second embodiments are replaced with an image reader unit 50. FIG. 4 shows a multi-function device 1A according to a modification of the first embodiment. FIG. 5 shows a multi-function device 201A according to a modification of the second embodiment. Configuration common to both the multi-function device 1A and the multi-function device 201A will first be described.

The image reader unit 50 is disposed above the printer section 2 and includes an image reader 50*a*, a document tray 50*b*, a discharge tray 50*c*, and transport rollers 50*h*. The image reader 50*a* houses the contact-type image sensor 10 described to the first and second embodiments. The document tray 50*b* extends slantingly rearward from a rear edge of the image reader 50*a*. The document tray 50*b* is for supporting documents before image pick up is performed on the documents. The discharge tray 50*c* extends horizontally forward from the front edge of the image reader 50*a*. The discharge tray 50*c* is for supporting documents after being discharged from the image reader 50*a* after image pick up. The transport rollers 50*h* are driven by a drive mechanism not shown in the drawings to transport documents past the image reader 50*a* in the direction from rear to front of the multi-function device 1A.

The image reader 50*a* is oriented at a slant, that is, with the rear surface of the image reader 50*a* raised higher than the front surface. The contact-type image sensor 10 is fixed facing downwards in the image reader 50*a*. A transport pathway 50*d* that is located below the image reader 50*a* connects the document tray 50*b* and the discharge tray 50*c* so that documents placed on the document tray 50*b* are transported below the image reader 50*a* and discharged onto the discharge tray 50*c*. The transport rollers 50*h* are provided at the both ends of the image reader 50*a*, that is, one of the transport rollers 50*h* is positioned where the transport pathway 50*d* connects with the document tray 50*b* and the other of the transport rollers 50*h* is positioned where the transport pathway 50*d* connects with the discharge tray 50*c*.

When an image of a document on the document tray 50*b* is to be picked up, the transport rollers 50*h* transport the document between the image reader 50*a* and the transport pathway 50*d*. The document is transported in the direction from the rear surface to the front surface of the multi-function device 1. Further, in the same way as in the first and second embodiment, the contact-type image sensor 10 picks up singles lines of image information while the document passes below the contact-type image sensor 10. The document is then discharged onto the discharge tray 50*c*.

In the multi-function device 1A of FIG. 4, the front surface cover 2*a* is opened up when pivoted downward as indicated by two-dot chain line in FIG. 4. Therefore, the process cartridge 11 can be mounted into and removed from the main casing while the front surface cover 2*a* is opened up in the same way as the first embodiment.

In the multi-function device 201A, the upper side of the printer section 2 is opened by pivoting the entire image reader unit 50 upward similar to the second embodiment. The process cartridge 11 can be mounted into the main casing from a position above the front surface of the main casing by inserting the process cartridge 11 downward and to the rear as indicated by an arrow D in FIG. 5. Other configuration and operation of the modifications of FIGS. 4 and 5 are the same as in the first and second embodiments.

Figure 6:
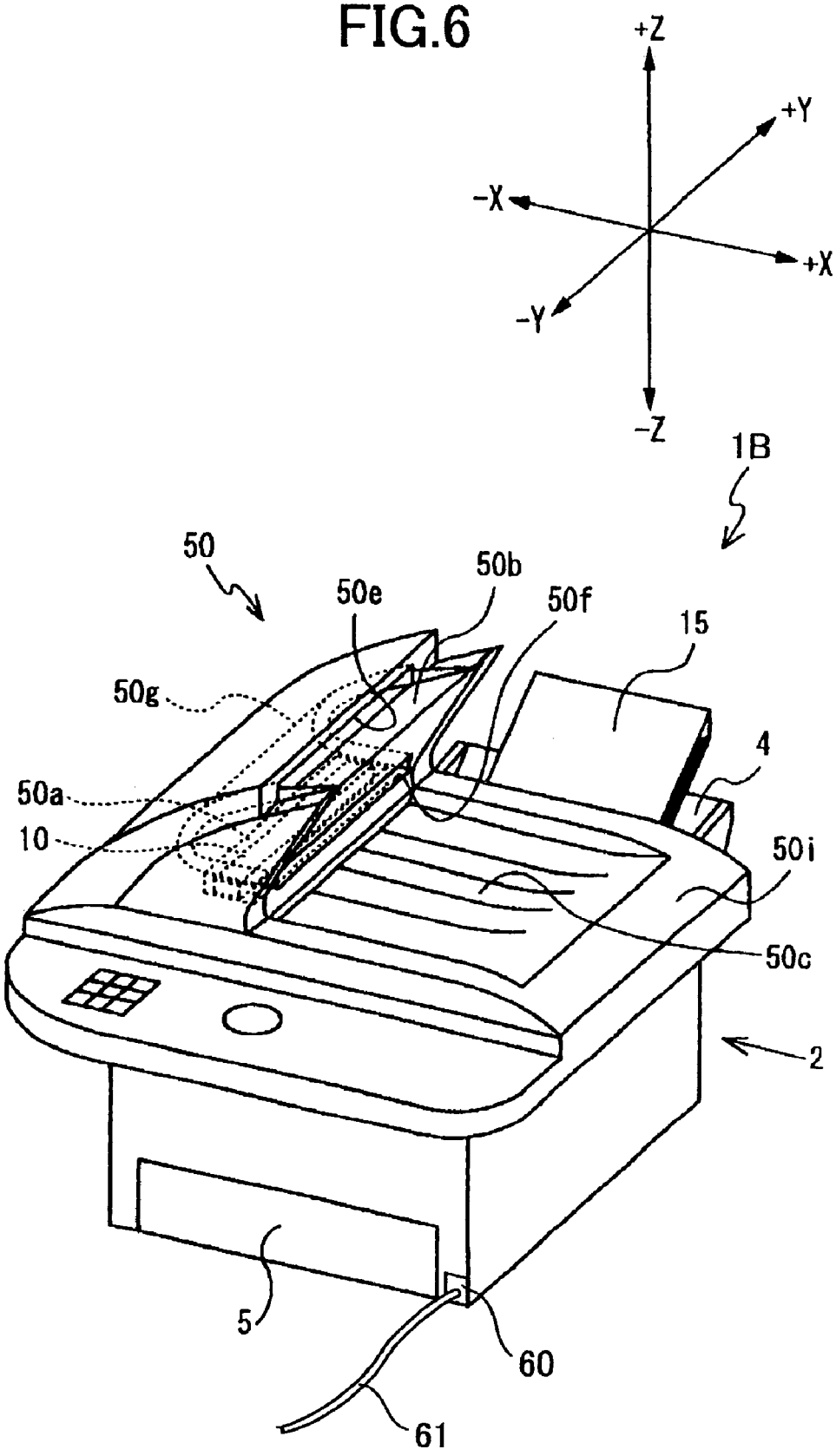
FIG. 6 is a perspective view showing a multi-function device according to a modification of the modifications shown in FIGS. 4 and 5.

The modifications shown in of FIGS. 4 and 5 describe the image reader unit 50 as transporting documents in the same direction that the printer section 2 transports sheets 15. However, the direction in which the image reader unit 50 transports the document can be substantially perpendicular to the direction in which the printer section 2 transports sheets 15. An example of such a configuration is shown in FIG. 6. In this example, the printer section 2 has a rectangular shape and is located above the sheet-supply cassette 5 in the same manner as the modification in FIG. 4. The sheet-supply cassette 5 supports a stack of sheets 15 so that the lengthwise dimension of the sheets 15 follows in Y-axis directions. The sheet-discharge tray 4 extends slantingly upward in a +Z/+Y-direction from a +Y-direction side (rear) surface of the printer section 2. The sheets 15 stacked on the sheet-supply cassette 5 are first fed out one at a time toward a −Y-direction side surface of the printer section 2, then guided and transported in the +Y-direction while being printed on in the printer section 2. After printing is completed, the sheets 15 are further transported in the +Y-direction and discharged onto the sheet-discharge tray 4.

The image reader unit 50 is shaped substantially as a reclining triangular column that extends in the Y-axial direction. The triangular column is defined by a slanting surface and two side walls. The side walls extend upward from the upper surface of the printer section 2 and are connected to opposite ends of the slanting surface with the slanting surface interposed therebetween. The slanting surface is formed by the −X-direction side surface of the printer section 2 and that extends in a slant toward above the center portion of the printer section 2. The document tray 50*b* is formed from the upper portion of the slanting surface. An opening 50*e* is opened slightly above the center of the slanting surface.

The remainder of the upper surface of the printer section 2, that is, portions where the image reader unit 50 is not positioned, serves as the discharge tray 50*c*. An opening 50*f* is opened in a side surface of the image reader unit 50 at a position between the opening 50*e* and the discharge tray 50*c*. Documents from which images have been picked up are discharged out through opening 50*f* and stacked on the discharge tray 50*c*. A transport pathway 50*g* is provided inside the image reader unit 50. The transport pathway 50*g* has a U-turn shape and connects the openings 50*e* and 50*f*. Although not shown in the drawings, a document transport mechanism is provided along the transport pathway 50*g* for transporting documents placed on the document tray 50*b* in a sheet transport direction from the opening 50*e* to the opening 50*f*. An image reader 50*a* is provided at a position below the transport pathway 50*g* and slightly upstream in the sheet transport direction from the opening 50*f*. The contact-type image sensor 10 of the scanner section 3 is fixed in the image reader 50*a*.

When an image of a document is to be picked up, the document is first placed on the document tray 50*b*. The document transport mechanism (not shown) transports the document into the image reader unit 50 through the opening 50*e*. The document passes along the transport pathway 50*g* and above the contact-type image sensor 10. In the same manner as in the first and second embodiments, the image from the document is picked up one line at a time and then the document is discharged out from the opening 50*f* and onto the discharge tray 50*c*. That is, the document is first transported in the −X-direction, then its transport direction is reversed and the document is discharged in the +X-direction. Said differently, the document is transported in a direction that is perpendicular to the Y-axis direction in which the sheets 15 are transported in the printer section 2. The upper side of the image reader unit 50 serves as a cover 50*i* that can be freely opened and closed. The image of a document can also be picked up by pivoting open the cover 50*i*, placing the document on a document support, which is made from a glass plate, and scanning the document.

Figure 7:
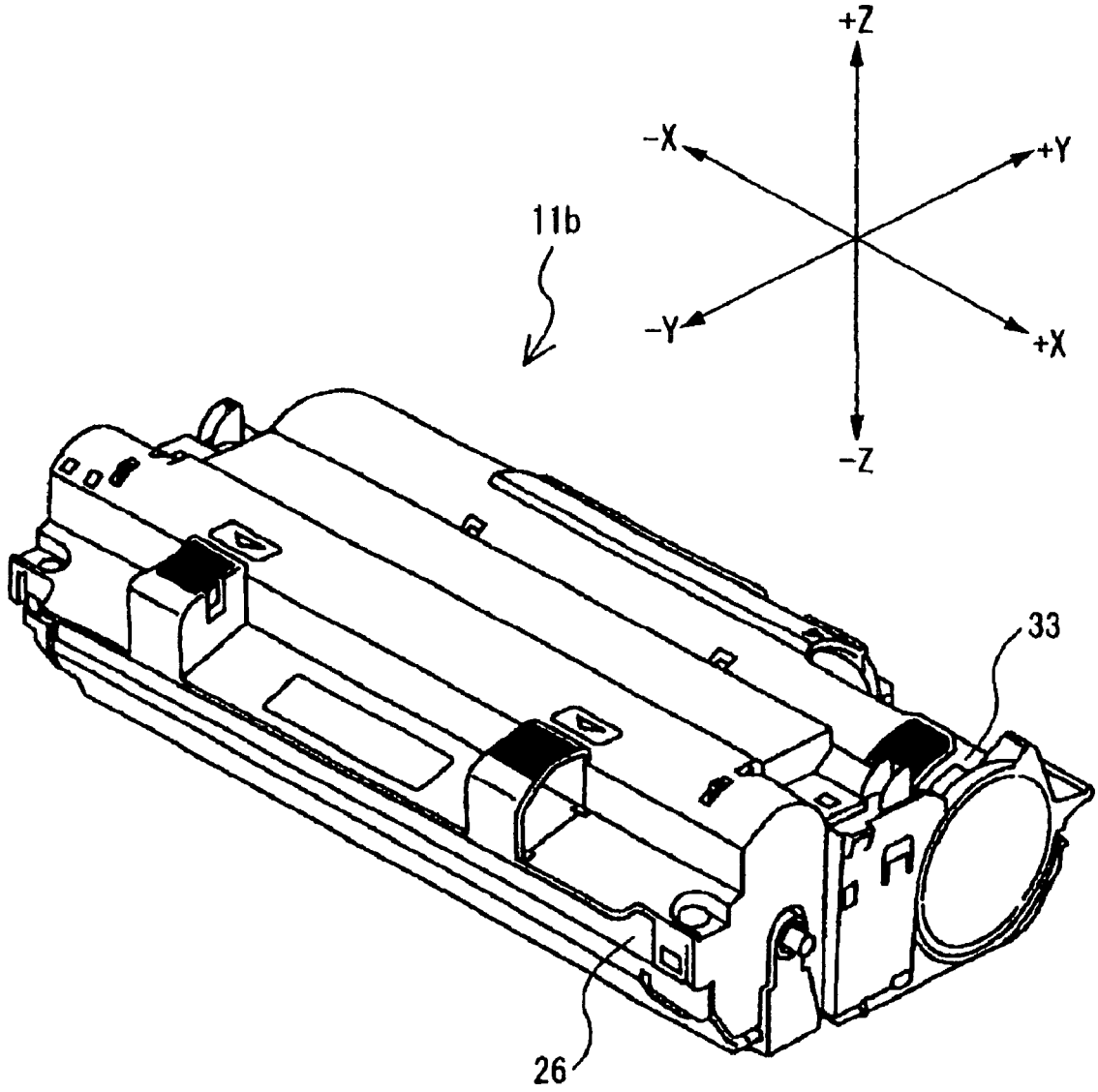
FIG. 7 is a perspective view showing a modification of a developing cartridge of the first embodiment.

Although the embodiments describe the toner box 33 as being an integral part of the developing cartridge 11*b*, the toner box 33 can be provided detachable from the developing cartridge 11*b*. An example of such a modification is shown in FIG. 7. In this example, the toner box 33 has a substantially cylindrical shape. The toner box 33 can be detached from the developing cartridge 11*b* by rotating the toner box 33 in the Z-Y plane while pulling the toner box 33 in the +X-direction. In this way, the toner box 33 can be separated from the developing roller 26 and the supply roller 31 (not shown in FIG. 7), which are housed separately within the developing cartridge 11*b*. With this configuration, the toner box 33 can be exchanged when toner runs out and the developing cartridge 11*b* can be reused. In the same manner as the first and second embodiments, the developing cartridge 11*b* mounted with the toner box 33 is mounted on the drum cartridge 11*a* so that the developing roller 26 presses against the photosensitive drum 24 of the drum cartridge 11*a*, and then the drum cartridge 11*a* and the developing cartridge 11*b* are mounted in the multi-function device 1 together as shown in FIGS. 2 and 3.

Although the embodiments describe the drum cartridge 11*a* and the developing cartridge 11*b* as being detachable from each other, the process cartridge 11 can be constructed in a manner that does not enable separation of the drum cartridge 11*a* from the developing cartridge 11*b*. For example, the process cartridge 11 can be configured with the photosensitive drum 24, the charger 25, the transfer roller 27, the cleaning roller 34, the developing roller 26, the supply roller 31, and the toner box 33 all in an integral cartridge. With this configuration, the process cartridge 11 requires fewer components and is easier and less expensive to produce.

While the invention has been described in detail with reference to the specific embodiments and modifications of embodiments thereof, it would be apparent to those skilled in the art that various changes and modifications may be made therein without departing from the spirit of the invention.

What is claimed is:

1. An image forming device comprising:

a main casing including a front surface and a rear surface on opposite sides thereof, the main casing further having an upper surface, the rear surface being formed with a sheet discharge opening;

an image forming section disposed within the main casing and including:

an input reception unit that receives image data from an external source; and a process unit including:

a process cartridge, the process cartridge including an electrostatic latent image bearing member; and an electrostatic latent image forming unit that forms an electrostatic latent image on the electrostatic latent image bearing member based on the image data received by the input reception unit, the process cartridge further including a developing agent supply unit that supplies developing agent to the electrostatic latent image bearing member to develop the electrostatic latent image on the electrostatic latent image bearing member into a visible image using the developing agent, the process cartridge being attached to and detached from the main casing through the front surface of the main casing;

an image reader section disposed on the upper surface of the main casing and above the image forming section and including:

an image reader that picks up image information from a document;

a document transport mechanism that transports the document past the image reader in a direction from the rear surface to the front surface of the main casing; and an output unit that outputs the image information to an external device;

a sheet supply unit that supplies a sheet to the process unit and that is located at a lower section of the main casing, the sheet supply unit being attached to and detached from the main casing through the front surface of the main casing, the process cartridge further including a transfer unit that transfers the visible image from the electrostatic latent image bearing member onto the sheet from the sheet supply unit;

a sheet discharge unit that discharges the sheet with the visible image rearward through the discharge opening in the main casing; and a sheet discharge tray provided to the outside of the main casing at a position under the discharge opening, the sheet discharge tray holding the sheet discharged through the discharge opening.

2. The image forming device as claimed in claim 1, wherein the sheet supply unit includes a sheet supply tray disposed below the process unit and further comprising a fixing unit disposed in the main casing above the sheet supply tray, the fixing unit fixing the visible image onto the sheet before the sheet discharge unit discharges the sheet through the discharge opening in the main casing.

3. The image forming device as claimed in claim 1, wherein an access opening is formed in the front surface, the access opening being for removing the developing cartridge by moving the developing cartridge at least one of forward and diagonally upward and forward.

4. The image forming device as claimed in claim 1, wherein the sheet supply unit includes a sheet supply tray disposed below the process unit, the sheet supply tray and the sheet discharge tray being disposed in a vertically overlapping condition with each other.

5. The image forming device as claimed in claim 1, wherein the sheet supply unit includes a sheet supply tray disposed below the process unit, the developing agent supply unit including:

a developing agent cartridge that holds developing agent;

a developing agent bearing member that bears developing agent from the developing cartridge and supplies the borne developing agent to the electrostatic latent image bearing member; and a developing cartridge provided integrally with the developing agent cartridge and the developing agent bearing member.

6. The image forming device as claimed in claim 5, wherein the process cartridge is detachably mounted at a position above the sheet supply tray, the developing cartridge being detachable with respect to the electrostatic latent image bearing member.

7. The image forming device as claimed in claim 1, wherein the sheet supply unit includes a sheet supply tray disposed below the process unit, the developing agent supply unit including:

a developing agent cartridge that holds developing agent; and a developing agent bearing member that bears developing agent from the developing cartridge and supplies the borne developing agent to the electrostatic latent image bearing member;

the electrostatic latent image bearing member, the developing agent cartridge, and the developing agent bearing member being integrally provided with the process cartridge.

* * * * *